US011145970B2

(12) United States Patent
Baek et al.

(10) Patent No.: US 11,145,970 B2
(45) Date of Patent: Oct. 12, 2021

(54) ANTENNA DEVICE

(71) Applicant: Samsung Electronics Co., Ltd., Gyeonggi-do (KR)

(72) Inventors: Kwang-Hyun Baek, Gyeonggi-do (KR); Seung-Tae Ko, Gyeonggi-do (KR); Yoon-Geon Kim, Busan (KR); Won-Bin Hong, Seoul (KR)

(73) Assignee: Samsung Electronics Co., Ltd

( * ) Notice: Subject to any disclaimer, the term of this patent is extended or adjusted under 35 U.S.C. 154(b) by 0 days.

(21) Appl. No.: 16/786,449

(22) Filed: Feb. 10, 2020

(65) Prior Publication Data

US 2020/0176864 A1 Jun. 4, 2020

Related U.S. Application Data

(62) Division of application No. 15/038,334, filed as application No. PCT/KR2015/001989 on Mar. 2, 2015, now abandoned.

(30) Foreign Application Priority Data

May 13, 2014 (KR) ..... 10-2014-0057077

(51) Int. Cl.
*H01Q 3/01* (2006.01)
*H01Q 3/46* (2006.01)
(Continued)

(52) U.S. Cl.
CPC ..... *H01Q 3/01* (2013.01); *H01Q 3/46* (2013.01); *H01Q 9/0442* (2013.01);
(Continued)

(58) Field of Classification Search
CPC ..... H01Q 1/2291; H01Q 1/24; H01Q 1/241; H01Q 1/242; H01Q 1/243; H01Q 1/38;
(Continued)

(56) References Cited

U.S. PATENT DOCUMENTS 6,952,185 B1 10/2005 Ryken, Jr. et al.
7,023,909 B1 4/2006 Adams et al.
(Continued)

FOREIGN PATENT DOCUMENTS

CN 1798485 7/2006
CN 1815806 8/2006
(Continued)

OTHER PUBLICATIONS

Chinese Office Action dated Jun. 3, 2020 issued in counterpart application No. 201580026193.0, 16 pages.
(Continued)

*Primary Examiner* — Dimary S Lopez Cruz
*Assistant Examiner* — Patrick R Holecek
(74) *Attorney, Agent, or Firm* — The Farrell Law Firm, P.C.

(57) ABSTRACT

Various embodiments of the present disclosure provide an antenna device, which comprises: a radiator for receiving a power supply signal; multiple tuning units disposed adjacently to or on the radiator, wherein the tuning units are short-circuited to the radiator or adjacent tuning units are selectively short-circuited to each other. The antenna device as described above can be variously implemented according to embodiments.

6 Claims, 11 Drawing Sheets

(51) Int. Cl.

| | |
|---|---|
| ***H01Q 9/44*** | (2006.01) |
| ***H01Q 13/10*** | (2006.01) |
| ***H01Q 19/30*** | (2006.01) |
| ***H01Q 1/22*** | (2006.01) |
| ***H01Q 9/04*** | (2006.01) |

(52) U.S. Cl.
CPC ..... *H01Q 13/10* (2013.01); *H01Q 19/30* (2013.01); *H01Q 1/2291* (2013.01)

(58) Field of Classification Search
CPC ..... H01Q 3/01; H01Q 19/005; H01Q 19/04; H01Q 19/22; H01Q 19/24; H01Q 19/28; H01Q 19/30; H01Q 9/0407; H01Q 9/045; H01Q 9/0442; H01Q 13/10
See application file for complete search history.

(56) References Cited

U.S. PATENT DOCUMENTS

| | | | | |
|---|---|---|---|---|
| 7,518,221 | B2 | 4/2009 | Gaucher et al. | |
| 7,671,804 | B2 | 3/2010 | Zhang et al. | |
| 8,144,064 | B2 | 3/2012 | Milosevic | |
| 8,614,650 | B2 | 12/2013 | Wilson | |
| 8,674,891 | B2 * | 3/2014 | Lopez | H01Q 5/335 343/753 |
| 8,760,352 | B2 | 6/2014 | Rao | |
| 9,306,291 | B2 | 4/2016 | Lu et al. | |
| 2006/0137904 | A1 | 6/2006 | Hirata | |
| 2006/0240882 | A1 | 10/2006 | Nagy et al. | |
| 2010/0123635 | A1 | 5/2010 | Lopez et al. | |
| 2011/0057853 | A1 | 3/2011 | Kim et al. | |
| 2011/0102289 | A1 | 5/2011 | Leem | |
| 2011/0122047 | A1 | 5/2011 | Ma et al. | |
| 2011/0193761 | A1 | 8/2011 | Shinkal et al. | |
| 2011/0248890 | A1 | 10/2011 | Lee et al. | |
| 2013/0207869 | A1 | 8/2013 | Han et al. | |
| 2014/0028515 | A1 * | 1/2014 | Lu | H01Q 1/36 343/793 |

FOREIGN PATENT DOCUMENTS

| | | |
|---|---|---|
| CN | 101083357 | 12/2007 |
| CN | 101145634 | 3/2008 |
| CN | 201114997 | 9/2008 |
| CN | 101345346 | 1/2009 |
| CN | 102074804 | 5/2011 |
| CN | 102176537 | 9/2011 |
| CN | 102308436 | 1/2012 |
| CN | 103367917 | 10/2013 |
| JP | 2005-204244 | 7/2005 |
| KR | 1020040045242 | 6/2004 |
| KR | 10-0562785 | 3/2006 |
| KR | 10-0813313 | 3/2008 |
| KR | 1020090047949 | 5/2009 |
| KR | 1020110049544 | 5/2011 |
| KR | 1020110076061 | 7/2011 |
| KR | 1020110114372 | 10/2011 |
| KR | 1020120121721 | 11/2012 |

OTHER PUBLICATIONS

PCT/ISA/210 Search Report issued on PCT/KR2015/001989 (pp. 3).
European Search Report dated Nov. 23, 2017 issued in counterpart application No. 15792956.3-1927, 11 pages.
Chinese Office Action dated Nov. 1, 2018 issued in counterpart application No. 201580026193.0, 13 pages.
Chinese Office Action dated Dec. 28, 2020 issued in counterpart application No. 201580026193.0, 10 pages.

* cited by examiner

ANTENNA DEVICE

PRIORITY

This application is Divisional Application of U.S. application Ser. No. 15/038,334, filed with the U.S. Patent and Trademark Office on May 20, 2016, and which is a National Phase Entry of PCT International Application No. PCT/KR2015/001989, which was filed on Mar. 2, 2015, and claims priority to Korean Patent Application No. 10-2014-0057077, which was filed on May 13, 2014, the contents of each of which are incorporated herein by reference.

BACKGROUND

1. Field

Various embodiments of the present disclosure relate to a communication device. For example, various embodiments of the present disclosure relate to an antenna device for providing a wireless communication function.

2. Description of the Related Art

Wireless communication techniques have recently been implemented in various forms (e.g., a wireless Local Area Network (w-LAN) that is represented by a WiFi technique, Bluetooth, and Near Field Communication (NFC)), in addition to a commercialized mobile communication network connection. Mobile communication services have been gradually evolved from the first generation mobile communication service to a super-high speed and large capacity service (e.g., a high-quality video streaming service), and it is expected that the next generation mobile communication service to be subsequently commercialized will be provided through an ultra-high frequency band of a dozen GHz or more.

As communication standards, such as w-LAN and Bluetooth, have become active, electronic devices (e.g., a mobile communication terminal) have been equipped with an antenna device that operates in various different frequency bands. For example, the fourth generation mobile communication service is operated in the frequency bands of, for example, 700 MHz, 1.8 GHz, and 2.1 GHz, WiFi is operated in the frequency bands of 2.4 GHz and 5 GHz, although it may slightly differ depending on a rule, and Bluetooth is operated in the frequency band of 2.45 GHz.

In order to provide a stabilized service quality in a commercialized wireless communication network, a high gain and a wide radiation area (beam coverage) of an antenna device should be satisfied. The next generation mobile communication service will be provided through an ultra-high frequency band of a dozen GHz or more (e.g., a frequency band that ranges from 30 GHz to 300 GHz and has a resonance frequency wavelength that ranges from 1 mm to 10 mm). A performance that is higher than that of an antenna device, which has been used in the previously commercialized mobile communication service, may be requested.

In general, as the operating frequency band increases, the size of an antenna device (e.g., a radiator that performs a direct radiating operation of a wireless signal) may decrease. Assuming that the resonance frequency of the antenna device is K, the radiator has an electric length of $N\times(\lambda/4)$ (here, N is a natural number). In order to mount an antenna device in a compact and weight-reduced electronic device like a mobile communication terminal, it is desirable that the antenna device also occupies a smaller mounting space so that a radiator having an electric length $\lambda/4$ may be mounted.

An antenna device, which operates in a frequency band that is currently used in a commercial communication network (e.g., 700 MHz, 1.8 GHz, or 2.1 GHz) or a frequency band that is currently used in, for example, w-LAN (e.g., 2.4 GHz, 2.45 GHz, or 5 GHz) may be easily optimized in terms of a radiating characteristic by changing the shape of a radiator even after the radiator has been manufactured, or by using a lumped element, such as a resistive, capacitive, or inductive element. Accordingly, in the process of developing an antenna device or even in the state where the antenna device is practically mounted in an electronic device, the performance of the antenna device, which is required by the electronic device, may be easily secured.

The resonance frequency wavelength of an antenna device, which is used for a wireless communication of the band of a dozen GHz or more (hereinafter, referred to as "mmWave communication"), is merely in the range of 1 to 10 mm, and the size of the radiator can be further reduced. In addition, in order to suppress transmission loss that occurs between a communication circuit and a radiator, an antenna device, which is used for mmWave communication, may be configured such that a Radio Frequency Integrated Circuit (RFIC) chip, which is mounted with a communication circuit unit, and a radiator may be disposed to be close to each other. Such an antenna device may be implemented in a module type by mounting the RFIC chip and the radiator on a printed circuit board that has a width and a length within 30 mm (e.g., 10 mm×25 mm).

The antenna device used for such mmWave communication may be manufactured after optimizing the operation characteristics of the antenna device through various simulations in the process of developing the antenna device. However, even if the operating characteristics of the antenna device are optimized, the operating characteristics may be distorted when the antenna device is practically mounted on an electronic device. In other words, the operating characteristics of the antenna device may be variously changed depending on a specification of the electronic device or the mounting environment of the manufactured antenna device.

In an antenna device for use in mmWave communication or an antenna device manufactured in a module type having a size within a dozen mm, however, it is practically impossible to change the shape of the radiator or to add or remove a lumped element.

Accordingly, in the case where a manufactured antenna device is mounted in an electronic device but does not exhibit an optimized operating characteristic, a considerable amount of time and expense may be required to develop and manufacture the antenna device until the practical production of the electronic device is enabled because it may be necessary to perform the initial simulation step and to develop the antenna device again.

SUMMARY

Accordingly, various embodiments of the present disclosure provide an antenna device that enables an operating characteristic required for an electronic device to be easily secured.

In addition, various embodiments of the present disclosure provide an antenna device that enables the time and expense required for developing and manufacturing an antenna device to be reduced.

Thus, various embodiments of the present disclosure provide an antenna device that includes a radiator formed in a multi-layered circuit board and configured to be provided with a power feeding signal, the radiator being formed by a plurality of first via holes formed in each of the layers of the multi-layered circuit board; a plurality of tuning units formed in the multi-layered circuit board and disposed adjacent to or on the radiator, the plurality of tuning units including a plurality of second via holes and a plurality of second via pads formed in each of the layers of the multi-layered circuit board; and at least one short circuit portion, with each of the tuning units being selectively short-circuited to the radiator via the at least one short circuit portion, or adjacent tuning units are selectively short-circuited to each other.

BRIEF DESCRIPTION OF THE DRAWINGS

The above and other objects, features and advantages of the present disclosure will be more apparent from the following detailed description in conjunction with the accompanying drawings, in which.

DETAILED DESCRIPTION

Figure 1:
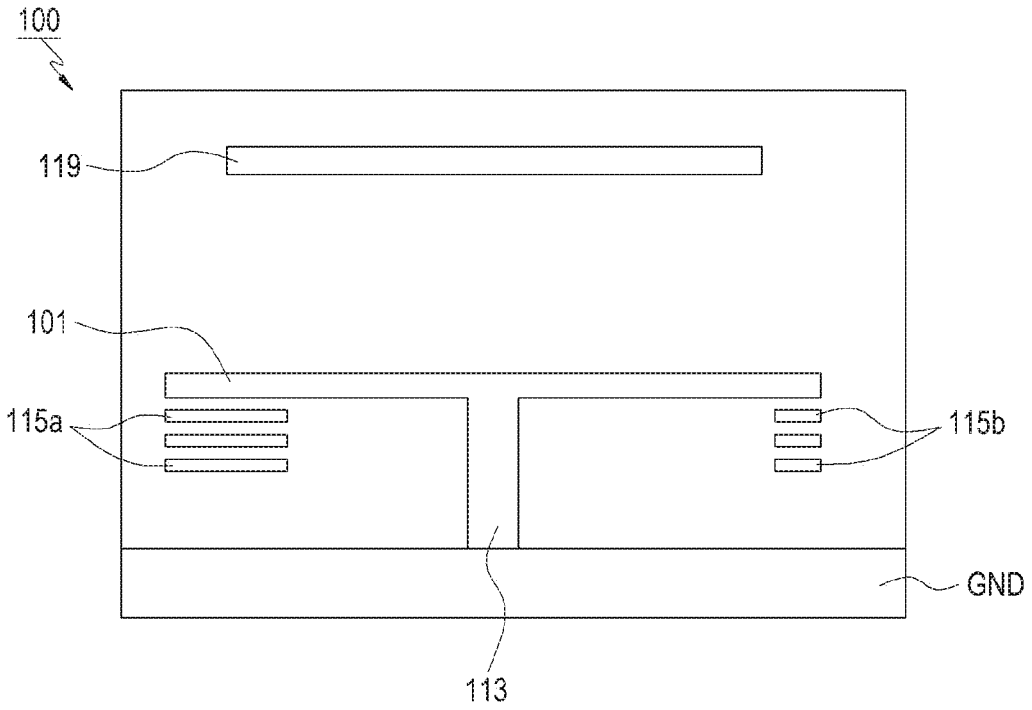
FIG. 1 is a diagram illustrating a configuration of an antenna device according to one of various embodiments of the present disclosure.
Figure 2:
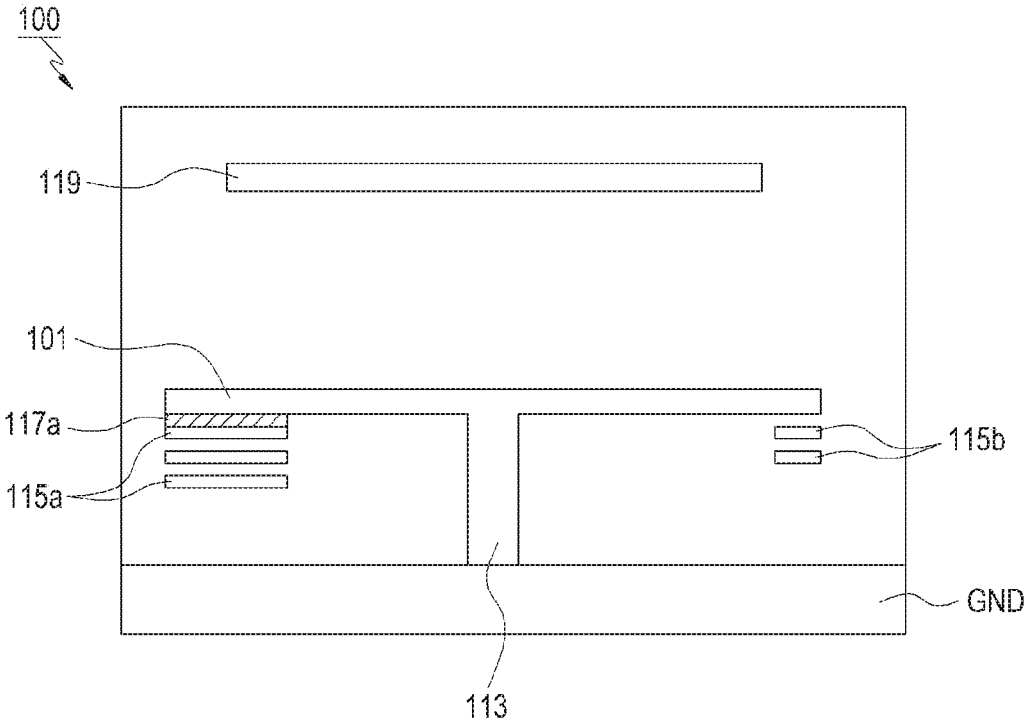
FIGS. 2 to 6 are diagrams illustrating different tuning structures of an antenna device according to one of various embodiments of the present disclosure.
Figure 3:
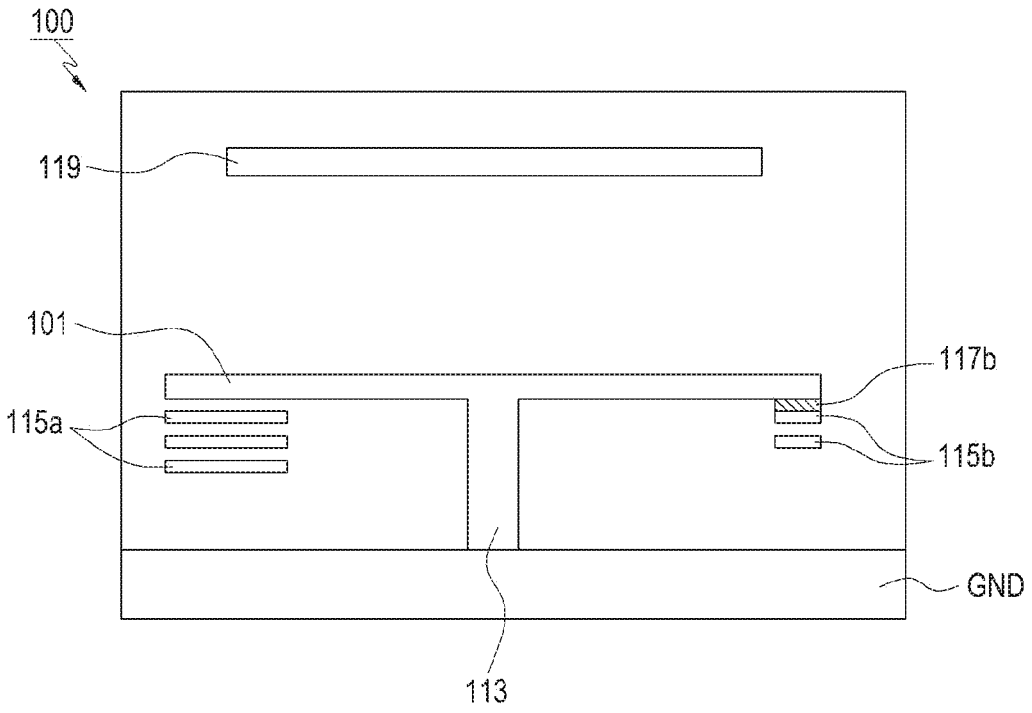
Figure 4:
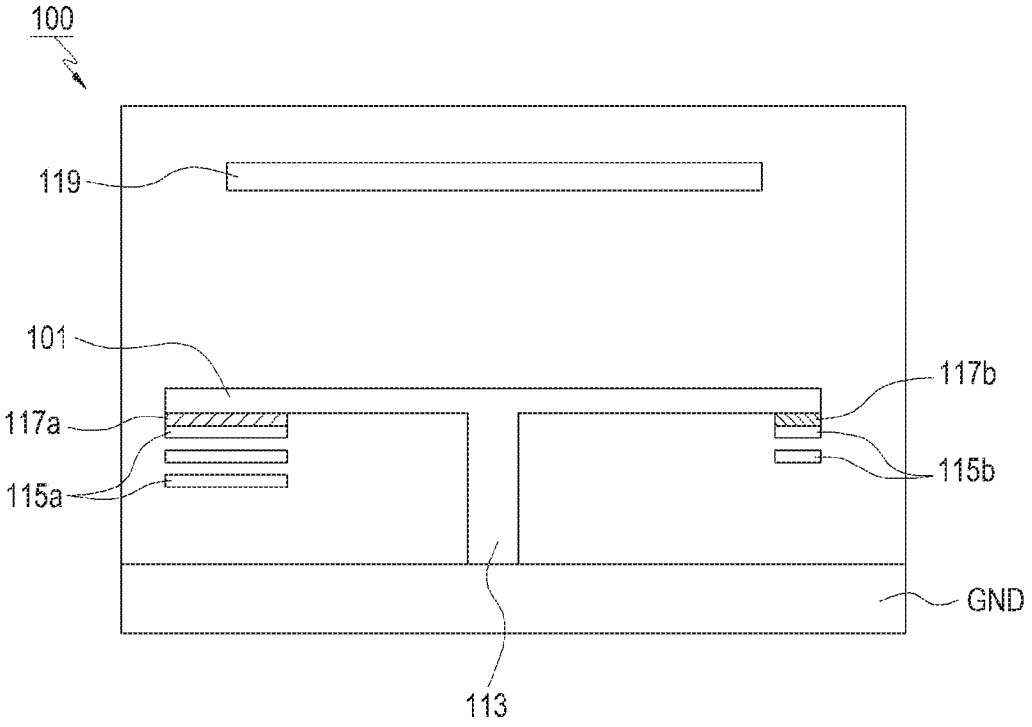
Figure 5:
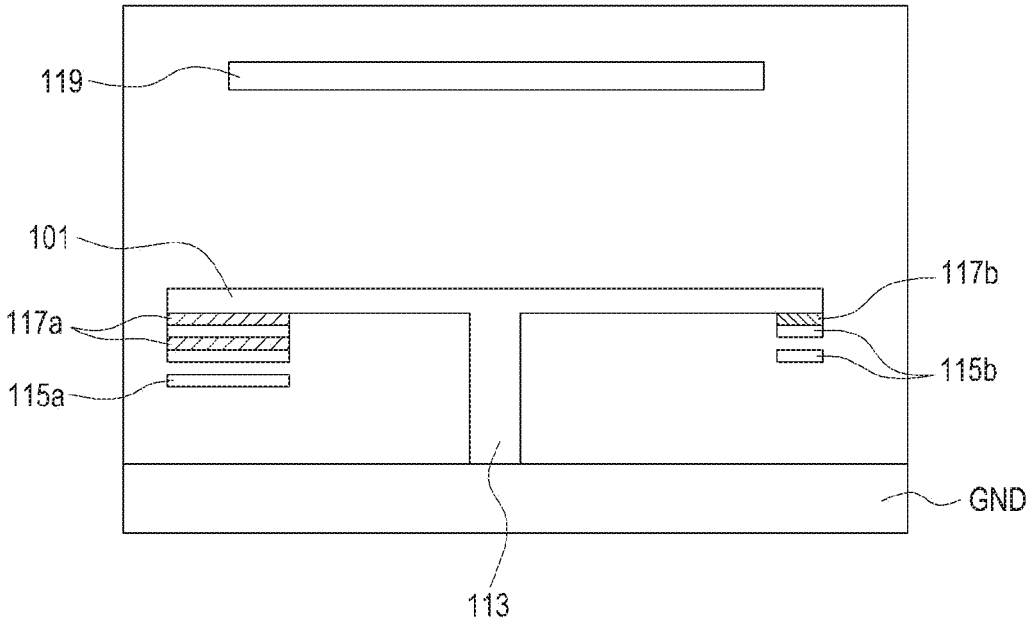
Figure 6:
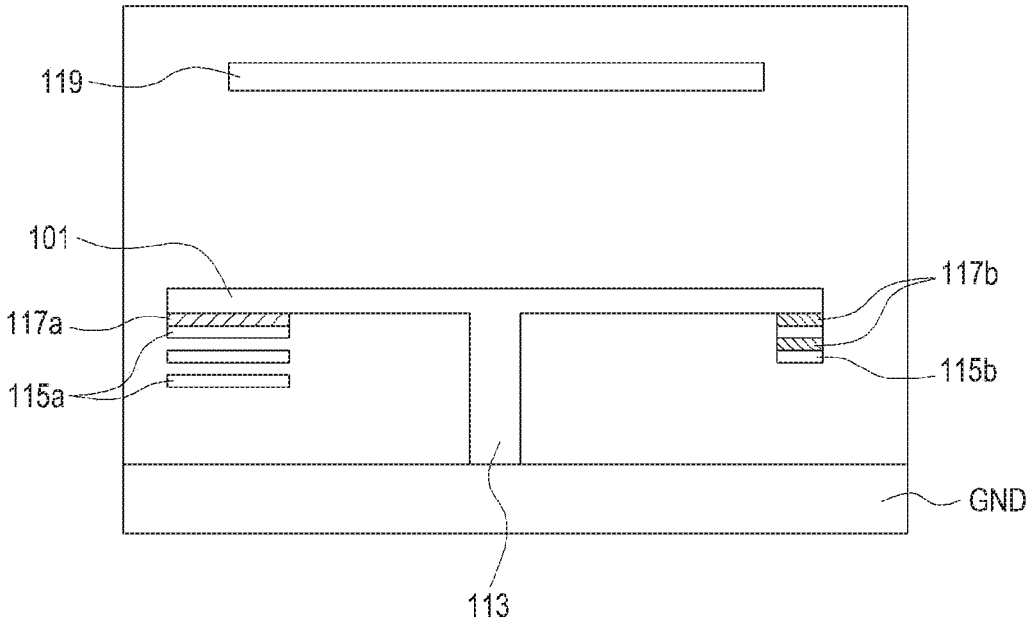

Embodiments of the present disclosure are described in detail with reference to the accompanying drawings. The same reference numbers are used throughout the drawings to refer to the same or like parts. Detailed description of well-known functions and structures incorporated herein may be omitted to avoid obscuring the subject matter of the present disclosure.

The present disclosure may be variously modified and may have various embodiments, some of which will be described in detail with reference to the accompanying drawings. However, it should be understood that the present disclosure is not limited to the specific embodiments, but the present disclosure includes all modifications, equivalents, and alternatives within the spirit and the scope of the present disclosure.

Although ordinal terms such as "first" and "second" may be used to describe various elements, these elements are not limited by the terms. The terms are used merely for the purpose to distinguish an element from the other elements. For example, a first element could be termed a second element, and similarly, a second element could be also termed a first element without departing from the scope of the present disclosure. As used herein, the term "and/or" includes any and all combinations of one or more associated items.

Further, the relative terms "a front surface", "a rear surface", "a top surface", "a bottom surface", and the like which are described with respect to the orientation in the drawings may be replaced by ordinal numbers such as first and second. In the ordinal numbers such as first and second, their order are determined in the mentioned order or arbitrarily and may not be arbitrarily changed if necessary.

In the present disclosure, the terms are used to describe specific embodiments, and are not intended to limit the present disclosure. As used herein, the singular forms are intended to include the plural forms as well, unless the context clearly indicates otherwise. In the description, it should be understood that the terms "include" or "have" indicate existence of a feature, a number, a step, an operation, a structural element, parts, or a combination thereof, and do not previously exclude the existences or probability of addition of one or more another features, numeral, steps, operations, structural elements, parts, or combinations thereof.

Unless defined differently, all terms used herein, which include technical terminologies or scientific terminologies, have the same meaning as that understood by a person skilled in the art to which the present disclosure belongs. Such terms as those defined in a generally used dictionary are to be interpreted to have the meanings equal to the contextual meanings in the relevant field of art, and are not to be interpreted to have ideal or excessively formal meanings unless clearly defined in the present specification.

An electronic device to be equipped with an antenna device, according to various embodiments of the present disclosure, may be an arbitrary device that is provided with a touch panel, and the electronic device may be referred to as, for example, a terminal, a portable terminal, a mobile terminal, a communication terminal, a portable communication terminal, a portable mobile terminal, or a display device.

For example, the electronic device may be a smartphone, a portable phone, a game player, a TV, a display unit, a heads-up display unit for a vehicle, a notebook computer, a laptop computer, a tablet Personal Computer (PC), a Personal Media Player (PMP), a Personal Digital Assistants (PDA), and the like. The electronic device may be implemented as a portable communication terminal which has a wireless communication function and a pocket size. Further, the electronic device may be a flexible device or a flexible display device.

The electronic device may communicate with an external electronic device, such as a server or the like, or perform an operation through an interworking with the external electronic device. For example, the electronic device may transmit an image photographed by a camera and/or position information detected by a sensor unit to the server through a network. The network may be a mobile or cellular communication network, a Local Area Network (LAN), a Wireless Local Area Network (WLAN), a Wide Area Network (WAN), an Internet, a Small Area Network (SAN) or the like, but is not limited thereto.

According to one of various embodiments of the present disclosure, the antenna device may be a Yagi-Uda antenna further including a director disposed at one side of the radiator to be parallel with the radiator, and the plurality of tuning units may be stacked at opposite ends of the radiator at another side of the radiator, respectively.

The tuning units disposed at one end of the radiator and the tuning units disposed at another end of the tuning units may have different lengths, respectively.

In the second embodiment, the antenna device may include a circuit board formed of a plurality of layers, in each of which a plurality of via holes are formed.

The via holes may be arranged in one of the layers in one direction (hereinafter, a "horizontal direction"), and respective via holes formed in one of the layers may be aligned with the via holes formed in another one of the layers such that the radiator is formed in a grid type.

The above-described antenna device may further include a plurality of first via pads provided between one of the layers (hereinafter, a "first layer") and another layer (hereinafter, a "second layer") adjacent to the first layer, and each of the first via pads interconnects a via hole formed in the first layer and a via hole formed in the second layer.

According to still another embodiment, the antenna device may further include a plurality of second via pads arranged in each of the layers to be adjacent to opposite ends of the arrangement of the first via pads in the horizontal direction, and the tuning units may include second via pads.

In still another embodiment, the antenna device may further include a plurality of second via holes formed in each of the layers and connected to at least one of the second via pads, and the tuning units may include second via pads.

In the antenna device as described above, the radiator may have an electric length of $N\times(\lambda/4)$, and the tuning units may be spaced apart from the radiator with a spacing that is less than $N\times(\lambda/4)$. Here, N is a natural number and $\lambda$ is a resonance frequency of the antenna device.

In the case where an antenna device, according to various embodiments of the present disclosure, includes a radiating patch having a plurality of slots formed therein and a short circuit portion formed to cross at least a portion of a slot selected among the plurality of slots, the short circuit portion may be formed by any one of a solder paste, a solder, a printed circuit pattern, and a conductive thin plate FIG. 1 is a diagram illustrating a configuration of an antenna device according to one of various embodiments of the present disclosure. FIGS. 2 to 6 are diagrams illustrating different tuning structures of an antenna device according to one of various embodiments of the present disclosure;

As illustrated in FIG. 1, according to one of various embodiments of the present disclosure, an antenna device 100 may include a radiator 101 configured to be fed with power and a plurality of tuning units 115*a* and 115*b* arranged at the opposite ends of the radiator 101 in a stacked form, respectively.

The radiator 101 is connected to a power feeding line 113 to be fed with power, and may perform the transmission/reception of a wireless signal. According to an embodiment, the radiator 101 may form a dipole antenna structure. The antenna device 100 may further include a director 119 that is arranged at one side of the radiator 101 to be parallel with the radiator 101. The radiator 101 and the director 119 are combined with each other such that the antenna device 100 may be implemented as a Yagi-Uda antenna.

The tuning units 115*a* and 115*b* may be stacked at the opposite ends of the radiator 101 at the other side of the radiator 101. The tuning units 115*a* stacked at one end of the radiator 101 and the tuning units 115*b* stacked at the other end may have different lengths, respectively. As illustrated in FIGS. 2 to 6, the antenna device 100 may further include short circuit portions 117*a* and 117*b* configured to short circuit the tuning units 115*a* and 115*b* to the radiator 101, or a tuning unit 115*a* or 115*b* that is adjacent thereto. The tuning units 115*a* and 115*b* may be stacked on the radiator 101 with an insulator or a dielectric material being interposed therebetween, and the short circuit portions 117*a* and 117*b* may be formed of a via hole or a conductor that is formed or arranged through the insulator or the dielectric material. As the tuning units 115*a* or 115*b* are short-circuited to the radiator 101 directly or via another tuning unit, the operating characteristic of the antenna device 100 (e.g., a resonance frequency and a bandwidth at the resonance frequency) may be variously set.

Figure 7:
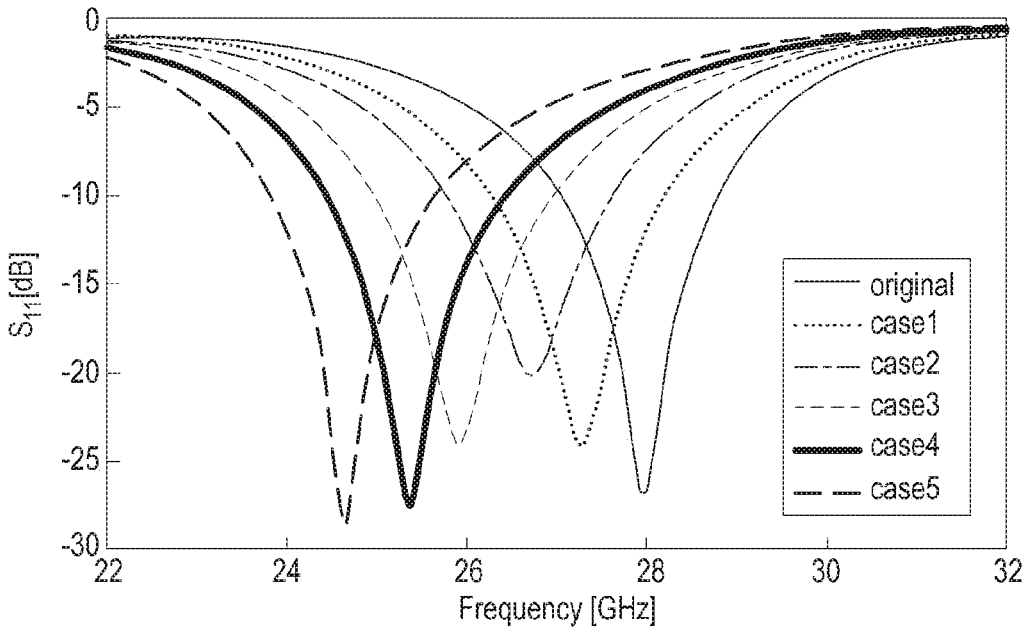
FIG. 7 is a graph representing reflection coefficients ($S_{11}$) measured from the antenna devices, which are illustrated in FIGS. 1 to 6, respectively.

FIG. 7 is a graph representing reflection coefficients ($S_{11}$) measured from the antenna devices, which are illustrated in FIGS. 1 to 6, respectively.

In FIG. 7, "original" represents the reflection coefficient of the antenna device illustrated in FIG. 1, and "case 1" to "case 5" represent the reflection coefficients of the antenna devices that are tuned in the forms of FIGS. 2 to 6, respectively. As illustrated in FIG. 7, it can be seen that, depending on a combination of the radiator 101 and the short-circuited tuning units 115*a* or 115*b*, the resonance frequency of the antenna device 100 may be adjusted.

The Table 1 below represents resonance frequencies that were obtained as a result of measuring the antenna devices 100, which have the tuning structures illustrated in FIGS. 1 to 6, respectively, and changes of the resonance frequencies that were obtained as a result of measuring the tuning structures illustrated in FIGS. 2 to 6 with respect to the antenna device 100 illustrated in FIG. 1. Such measurements were performed based on a structure in which the tuning units 115*a* disposed at the left side of the radiator 101 were designed to have a length of 0.05 times the resonance frequency wavelength of the antenna device 100 (e.g., 0.05 mm) and the tuning units 115*b* disposed at the right side were designed to have a length of 0.02 times the resonance frequency wavelength (e.g., 0.02 mm).

TABLE 1

| | original | case 1 | case 2 | case 3 | case 4 | case 5 |
|---|---|---|---|---|---|---|
| Resonance frequency (GHz) | 27.97 | 27.29 | 26.74 | 25.92 | 25.36 | 24.64 |
| Resonance frequency change (GHz) | — | 0.68 | 1.23 | 2.05 | 2.61 | 3.33 |

As represented in Table 1, it can be seen that, as the tuning units 115*a* disposed at the left end of the radiator 101 are short-circuited to the radiator 101, a resonance frequency change of about 0.6 to 0.7 GHz is caused per one short-circuited tuning unit in the structures illustrated in FIGS. 1 to 6. In addition, it can be seen that, as the tuning units 115*b* disposed at the right end of the radiator 101 are short-circuited to the radiator 101, a resonance frequency change of about 1.2 to 1.3 GHz is caused per one short-circuited tuning unit. In this way, even if antenna devices according to various embodiments of the present disclosure have the substantially same structures, different operating characteristics can be implemented by changing the arrangements of the short circuit portions 117*a* and 117*b* (e.g., by differing combinations of tuning units short-circuited to the radiator).

In the state where one antenna device selected from the above-described antenna devices is mounted in an electronic device, when the mounted antenna device cannot exhibit an operating characteristic required by the electronic device, the mounted antenna device may be replaced by another antenna device that has a different combination of tuning units short-circuited to the radiator. Therefore, when an antenna device that has been fabricated up to now does not exhibit a proper performance in the electronic device, an antenna device suitable for the corresponding antenna device can be easily selected and mounted even if a new antenna device is neither developed nor manufactured.

Figure 8:
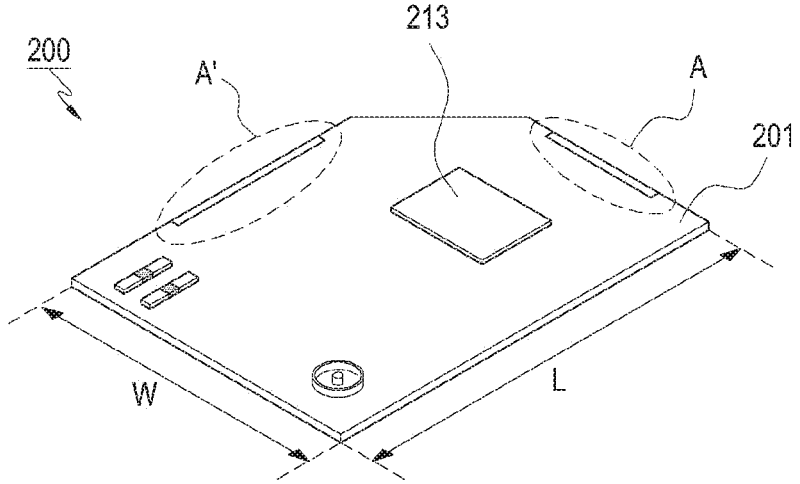
FIG. 8 is a perspective view illustrating an antenna device according to another one of various embodiments of the present disclosure.
Figure 9:
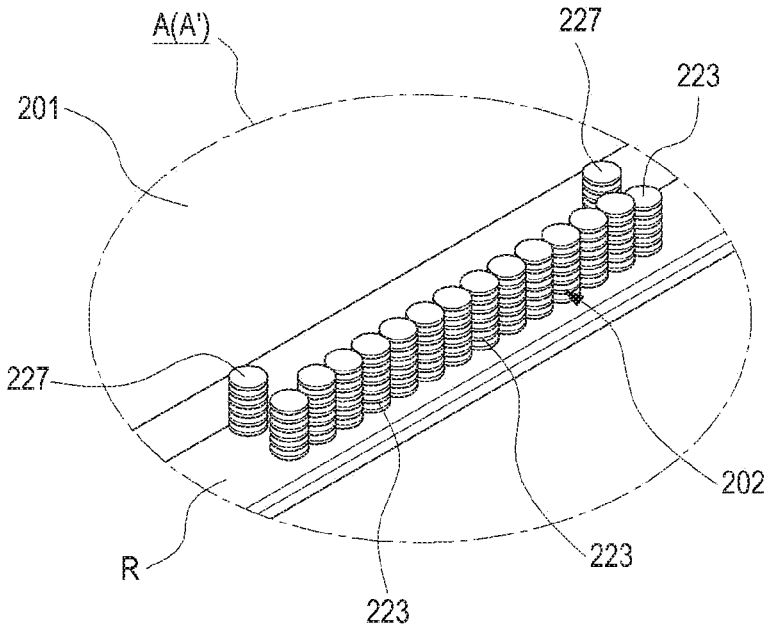
FIG. 9 is a view for describing a radiator of an antenna device according to another one of various embodiments of the present disclosure.
Figure 10:
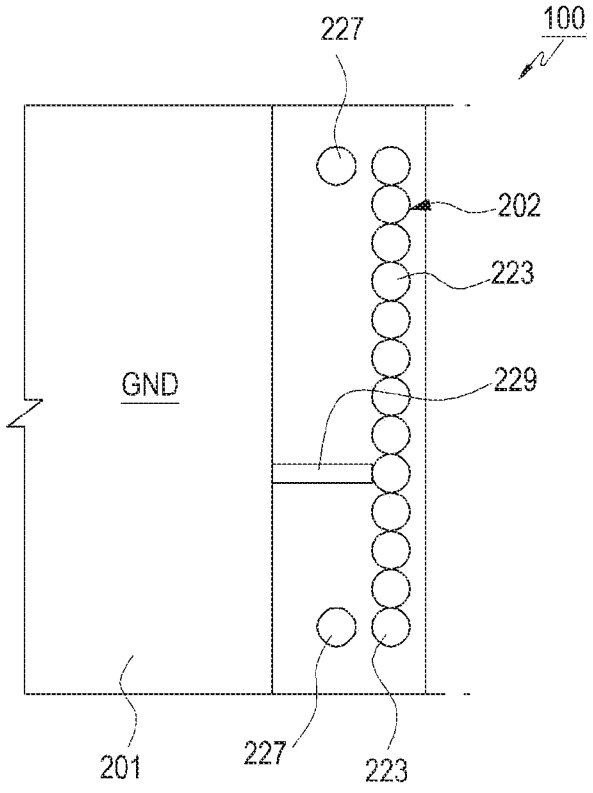
FIG. 10 is a plan view for describing a radiator of an antenna device according to another one of various embodiments of the present disclosure.
Figure 11:
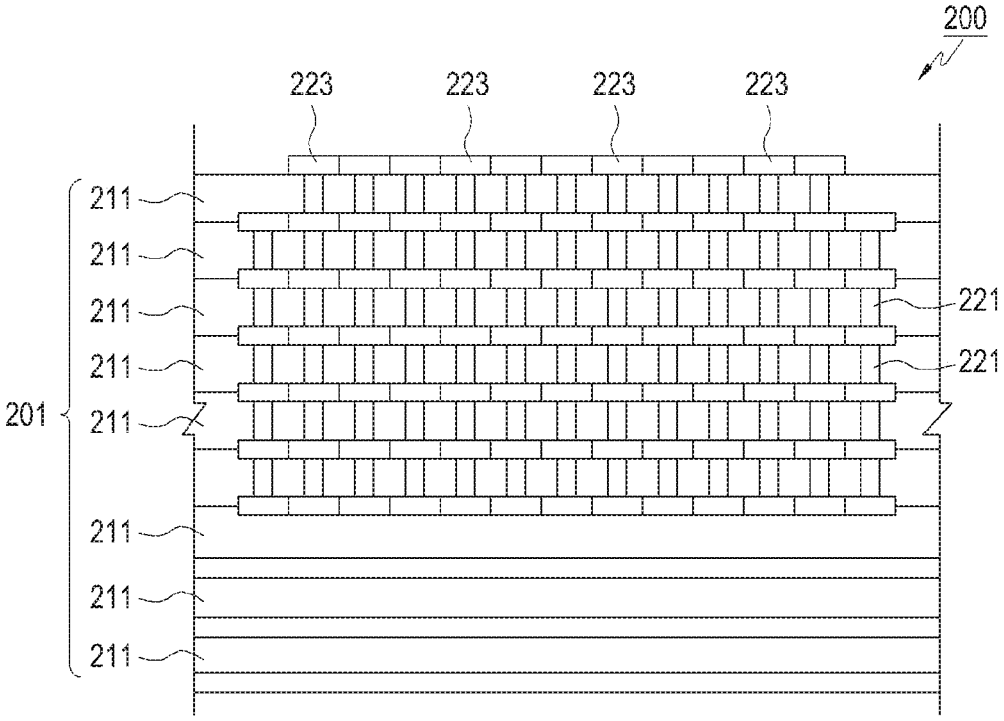
FIG. 11 is a first side view for describing a radiator of an antenna device according to another one of various embodiments of the present disclosure.
Figure 12:
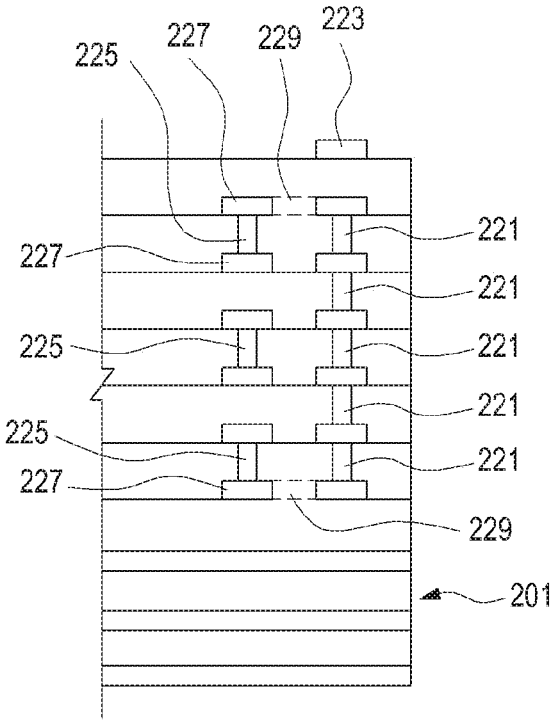
FIG. 12 is a second side view for describing a radiator of an antenna device according to another one of various embodiments of the present disclosure.

FIG. 8 is a perspective view illustrating an antenna device according to another one of various embodiments of the present disclosure. FIG. 9 is a view for describing a radiator of an antenna device according to another one of various embodiments of the present disclosure. FIG. 10 is a plan view for describing a radiator of an antenna device according to another one of various embodiments of the present disclosure. FIG. 11 is a first side view for describing a radiator of an antenna device according to another one of various embodiments of the present disclosure. FIG. 12 is a second side view for describing a radiator of an antenna device according to another one of various embodiments of the present disclosure.

Referring to FIGS. 8 to 12, according to another one of various embodiments of the present disclosure, an antenna device 200 may further include a circuit board 201, and a radiator 202 may be implemented inside the circuit board 201. The circuit board 201 may be formed of a multi-layered circuit board that is 10 mm in width (W) and 25 mm in length (L), and each layer 211 may be provided with first via holes 221. An arrangement of the first via holes 221 may form a radiator 202 in a grid form.

It is noted that FIGS. 9 to 12 illustrate the circuit board 201 in a state where a portion of the circuit board 201 (e.g., the layers 211 around the first via holes 221) is partially removed in order to illustrate the configuration of the radiator 202 or the like more clearly.

The circuit board 201 has a plurality of layers 211 laminated therein, and may be formed of a flexible printed circuit board, a dielectric board, or the like. Each of the layers 211 may include a printed circuit pattern or a ground layer that is formed of a conductor and via holes that are formed to penetrate the front and rear faces (or top and bottom faces). In general, via holes, which are formed in a multi-layered board, are formed in order to electrically interconnect printed circuit patterns, which are formed in different layers, or in order to dissipate heat. In the antenna device 200, some of the via holes formed in the circuit board 201 (e.g., the first via holes 221 formed in an edge of the circuit board 201 (e.g., a region indicated by "A" or "A'")) may be arranged in a grid form to be utilized as the radiator 202.

In a certain embodiment, each of the layers 211 of the circuit board 201 may include a plurality of first via holes 221 that are arranged in one direction (hereinafter, a "horizontal direction") in a partial region (e.g., a region adjacent to an edge). When the respective layers 211 are laminated to complete the circuit board 201, the first via holes 221 formed in one layer (hereinafter, a "first layer") among the layers 211 may be aligned with the first via holes 221 formed in another layer (hereinafter, a "second layer") adjacent to the first layer. The first via holes of the first layer and the first via holes of the second layer may be aligned in a straight line. Between the first via holes of the first layer and the first via holes of the second layer, first via pads 223 are disposed, respectively, so that a stable connection may be provided between two first via holes 221 that are disposed in adjacent and different layers.

Since the radiator 202 is formed of the first via holes 221 inside the circuit board 201, the radiator 202 may be connected to a communication circuit unit (e.g., an RFIC chip 213) or a ground unit GND that is provided on the circuit board 201, even if a separate connection member or the like is not arranged. That is, a power feeding line 229 and a ground line may be connected to the radiator 202 in the process of manufacturing the circuit board 201. It is noted that the power feeding line 229 is illustrated as if it is connected to the ground unit GND since FIG. 10 illustrates the circuit board 201 formed of a plurality of layers 211 in the state where a portion of the circuit board 201 is removed. The power feeing line 229 may be connected to one of the first via holes 221 so that a power feeding signal may be provided from a communication circuit unit (e.g., the RFIC chip 213) that is formed on the circuit board 201.

The power feeding line 229 or the ground unit GND may be formed on a layer 211 that is positioned on the surface of the circuit board 201.

A tuning unit of the antenna device 200 may be implemented by the second via holes 225 and the second via pads 227 that are disposed to the opposite ends of the radiator 202, respectively.

The second via holes 225 may be disposed to be adjacent to the first via holes 221 in each of the layers 211 of the circuit board 201, or in some selected layers. The second via pads 227 may also be disposed to be adjacent to the first via pads 223 in each of the layers 211 of the circuit board 201, or in some selected layers. FIG. 12 exemplifies a configuration in which the second via holes 225 are only formed in some of the layers 211 of the circuit board 201, and each of the second via pads 227 is connected to only one via hole 225. However, similarly to the first via pads 223, a second via hole 225 may be formed and aligned in each of the adjacent two layers. In such a case, the second via pad 227 may interconnect adjacent second via holes 225.

Referring to FIG. 12, the antenna device 200 may include short circuit portions 229, each of which short circuits a selected one of the tuning units (combinations of the second via holes 225 and the second via pads 227) to the radiator 202. The short circuit portions 229 may selectively short circuit the tuning units to the radiator 202, respectively. Depending on the arrangements of the short circuit portions 229 (e.g., depending on the combinations of the tuning units to be short-circuited to the radiator 202), the antenna device 200 may implement different operating characteristics.

Figure 13:
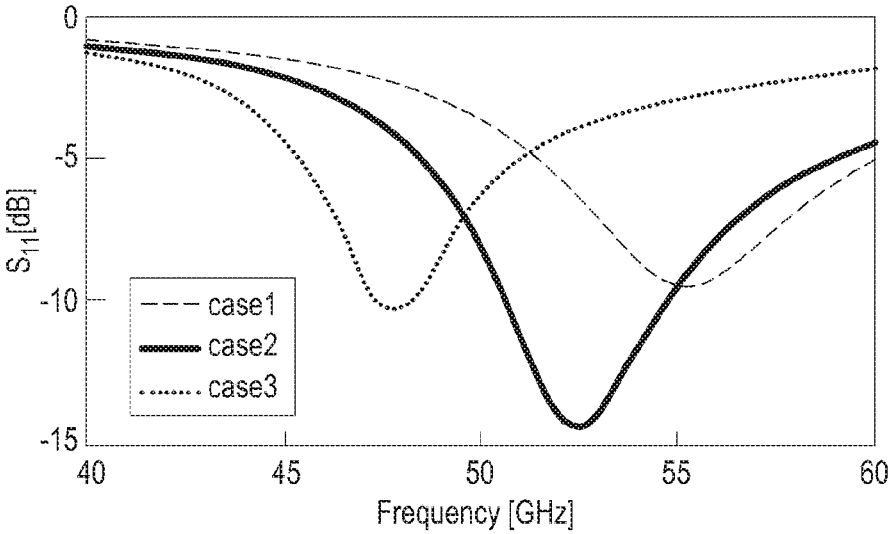
FIG. 13 is a graph representing reflection coefficients ($S_{11}$) measured depending on the tuning structure of the antenna device illustrated in FIG. 10.

FIG. 13 is a graph representing reflection coefficients ($S_{11}$) measured depending on the tuning structure of the antenna device illustrated in FIG. 10.

In FIG. 13, "case 1" represents a reflection coefficient of the antenna device 200 that was measured in the state where the tuning units were not short-circuited to the radiator 202, in which case a resonance frequency of 55.3 GHz may be formed. In FIG. 13, "case 2" represents a reflection coefficient of the antenna device 200 that was measured in the state where the upper tuning units among the tuning units illustrated in FIG. 10 were short-circuited to the radiator 202, in which case a resonance frequency of 52.5 GHz may be formed. In FIG. 13, "case 3" represents a reflection coefficient of the antenna device 200 that was measured in the state where each of the tuning units illustrated in FIG. 10 was short-circuited to the radiator 202, in which case a resonance frequency of 47.9 GHz may be formed. As described above, the resonance frequency of the antenna device 200 may be adjusted depending on the combinations of the short-circuited tuning units.

When the number of tuning units arranged around the radiator 202 increases, more various combinations of the tuning units short-circuited to the radiator 202 can be obtained. When more various combinations of the tuning units short-circuited to the radiator 202 can be obtained in a substantially equal antenna structure (e.g., the structure of the radiator 202), antenna devices having various and different operating characteristics can be manufactured. Among the antenna devices that have various and different operating characteristics while having the same standards (e.g., a size and a shape), an antenna device, which is suitable for a requested specification, may be selected and easily mounted or replaced to an electronic device.

Meanwhile, in forming the above-described antenna device 100 or 200, the radiator 101 or 202 may be manufactured to have the electric length of $N\times(\lambda/4)$. Further, the tuning units 115*a* and 115*b*, or 225 and 227 may be arranged to be spaced apart from the radiator 101 or 202 at a spacing that is less than $N\times(\lambda/4)$. Here, N means a natural number, and $\lambda$ means the resonance frequency of each antenna device.

Figure 14:
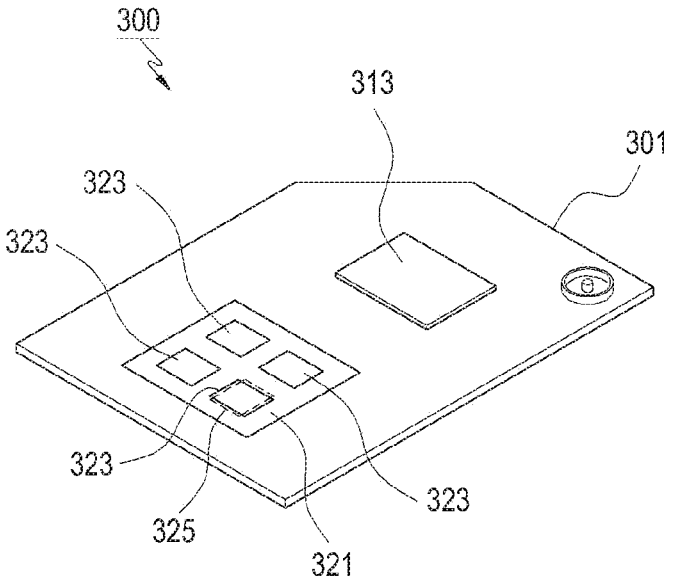
FIG. 14 is a perspective view illustrating an antenna device according to still another one of various embodiments of the present disclosure.
Figure 15A:
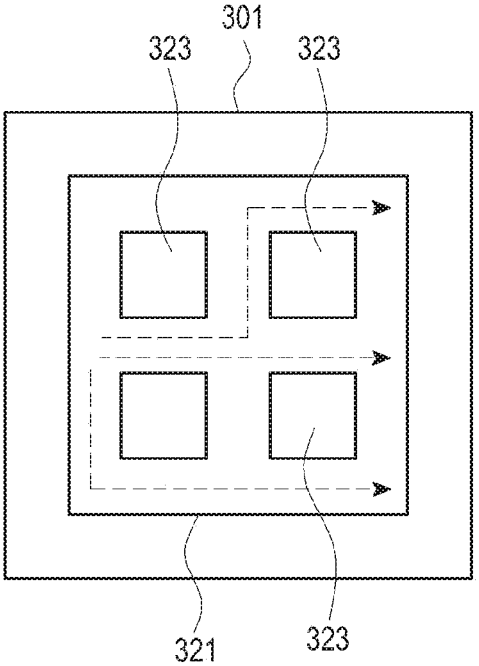
FIGS. 15A to 15D and FIG. 16 are views for describing exemplary tuning of an antenna device and a change in operating characteristic, which is caused by the tuning, in an antenna device according to still another one of various embodiments of the present disclosure.
Figure 15B:
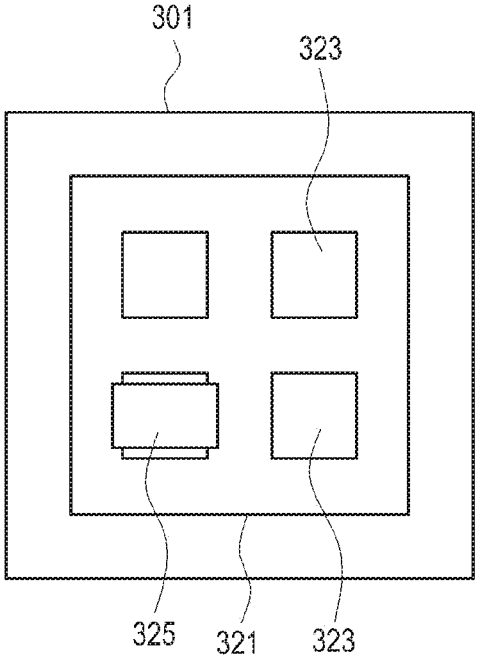
Figure 15C:
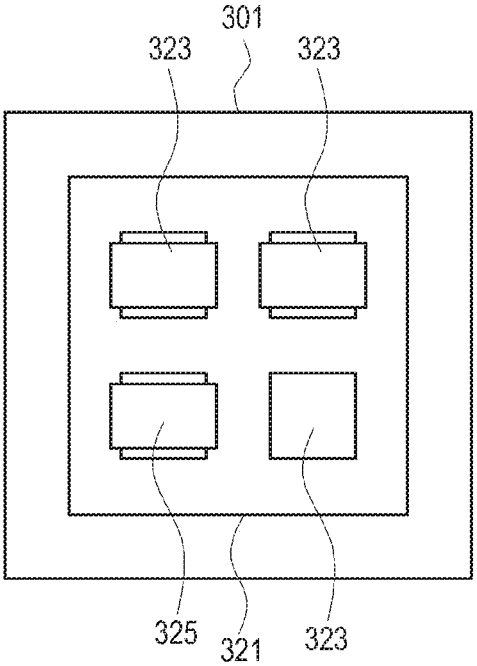
Figure 15D:
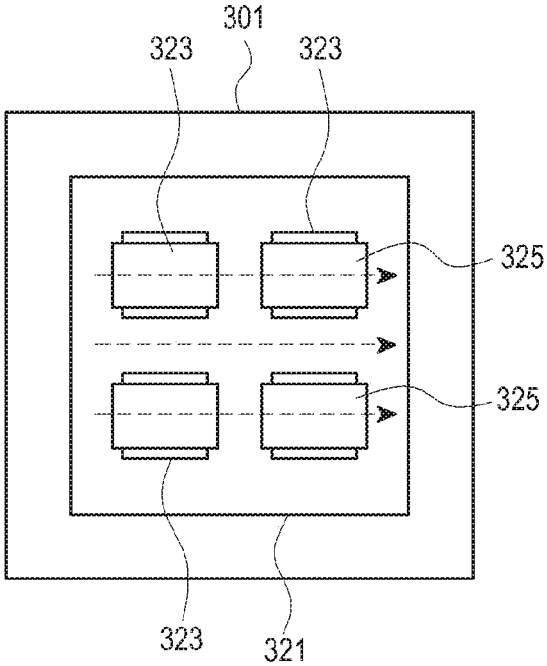
Figure 16:
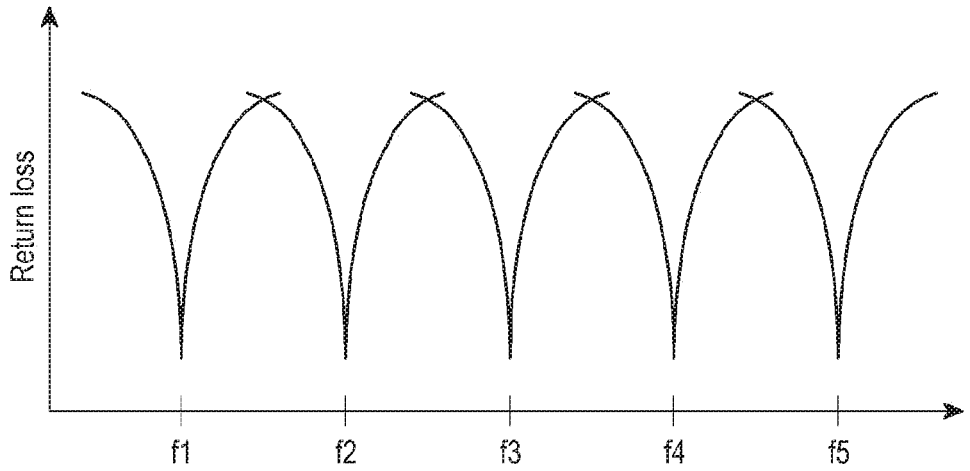

FIG. 14 is a perspective view illustrating an antenna device according to still another one of various embodiments of the present disclosure.

Referring to FIG. 14, according to another one of various embodiments of the present disclosure, an antenna device 300 may include a radiation patch 321 that has a flat plate shape and is formed with a plurality of slots 323, and a short circuit portion 325 that is formed to cross at least a portion of a selected one of the slots 323. The radiation pattern 321 may be disposed on one surface of a circuit board 301 on which an RFIC chip 313 is mounted. The short circuit portion 325 may be formed of a solder paste, soldering, a printed circuit pattern, a conductive thin plate, or the like, and may be formed of other various conductive materials that can be electrically connected with the radiation patch 321.

As in the preceding embodiment, the circuit board 301 may be made of a multi-layered circuit board having a size of about 10 mm*25 mm. The radiation patch 321 may have an electric length of $N\times(\lambda/4)$ (e.g., an electric length of $\lambda/4$). While FIG. 14 exemplifies a configuration in which four slots 323, which have the same shape and size, are formed in the radiation patch 321, the shape or the size of the slots 323 may be variously modified depending on the specification of an antenna device.

FIGS. 15A to 15D and FIG. 16 are views for describing exemplary tuning of an antenna device and a change in the operating characteristics, which is caused the tuning, in an antenna device according to still another one of various embodiments of the present disclosure.

Referring to FIGS. 15A to 15D, the flows of signal currents (dot line arrows) distributed on the radiation patch may variously appear according to the number and arrangement of the short circuit portions 325. Through this, antenna devices 300 may be implemented to have various and different operating characteristics. For example, in FIG. 16, f1 represents a resonance frequency of the antenna device 300 in the state where the short circuit portion 325 is not disposed, f2 to f5 represent resonance frequencies of the antenna devices 300 that have tuning structures according to combinations of short circuit portions 325 in which the slots 323 are disposed (e.g., the tuning structures illustrated in FIGS. 15*b* to 15*d*), respectively. When one or more short circuit portions 325 are selectively arranged in the radiation patches 321, in which a plurality of slots 323 are formed, the operating characteristics of the antenna device 300 (e.g., a resonance frequency or a bandwidth at the resonance frequency) can be variously implemented. Hereinafter, more specific implementing examples of the antenna device 300 will be described with reference to FIGS. 17 to 23.

Figure 23:
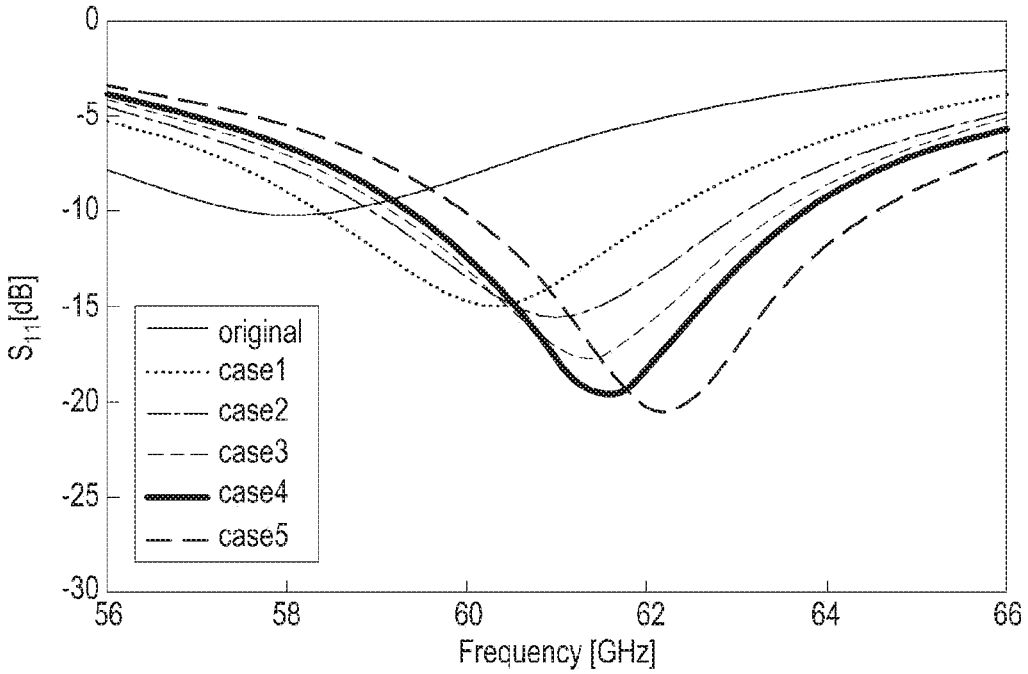
FIG. 23 is a graph representing reflection coefficients ($S_{11}$) measured from the antenna devices, which are illustrated in FIGS. 17 to 22, respectively.

FIGS. 17 to 22 are implementing examples of an antenna device according to still another one of various embodiments of the present disclosure, and FIG. 23 is a graph representing reflection coefficients ($S_{11}$) measured from the antenna devices, which are illustrated in FIGS. 17 to 22, respectively.

Referring to FIGS. 17 to 23, when the radiation patch 321 is fed with power, a distribution of signal currents appears on the radiation patch 321, in which high signal currents are distributed in a specific region (e.g., the region indicated by "C") depending on the power feeding position and the distribution of the signal currents may gradually decrease as the distance from the corresponding region increases. Such a distribution of signal currents may vary depending on various factors, such as an arrangement environment and a power feeding structure of the antenna device 300. However, in the present embodiment, a configuration in which the distribution of signal currents appears high in the region indicated by "C" will be described as an example in order to make the description short and clear. In addition, the short circuit portion 325 may be formed to cross only a portion of a slot 323. In describing the present embodiment, however, a configuration, in which a short circuit portion 325 arranged on any one slot is arranged in a structure of completely closing the corresponding slot, will be described.

As illustrated in FIGS. 17 to 22, the slots 323 may be formed to have different sizes or shapes depending on the positions thereof. On each of the drawings, the signal currents may be distributed most highly in the central portion of the upper end of the radiation patch 321.

Figure 17:
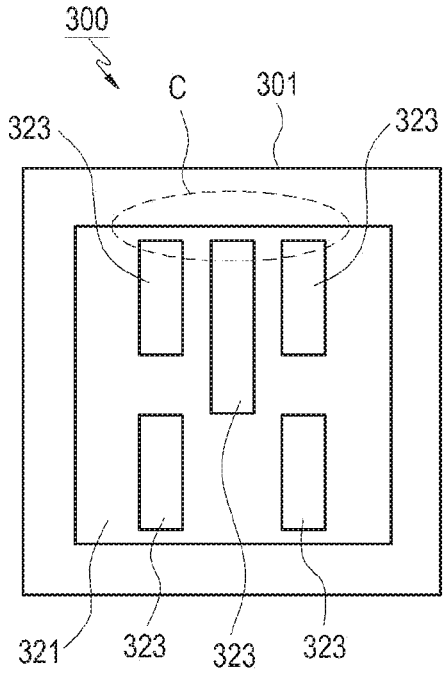
FIGS. 17 to 22 are implementing examples of an antenna device according to still another one of various embodiments of the present disclosure.
Figure 18:
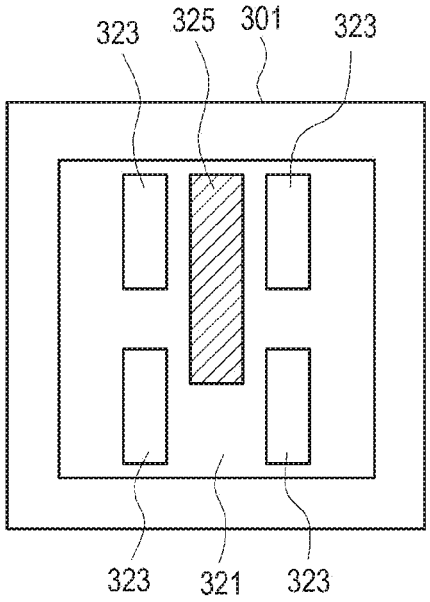
Figure 19:
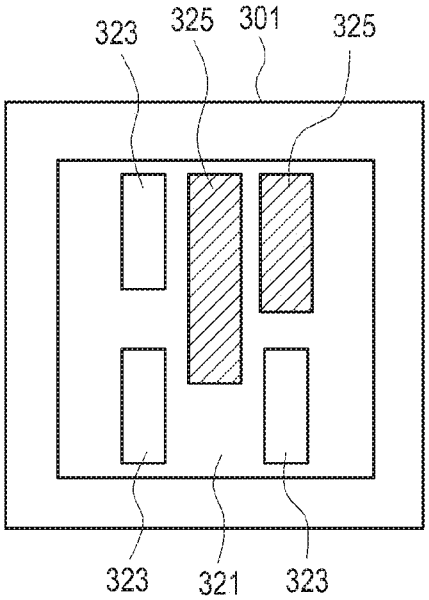
Figure 20:
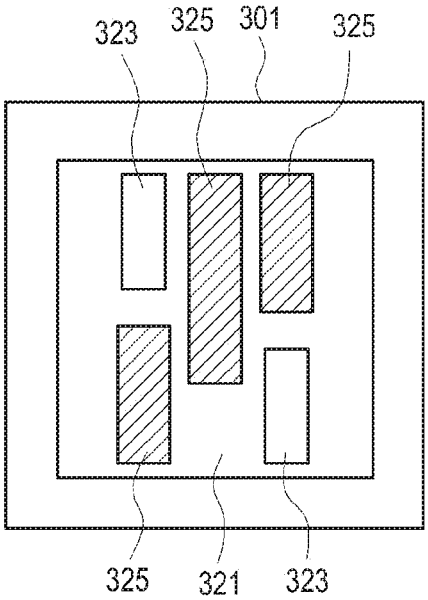
Figure 21:
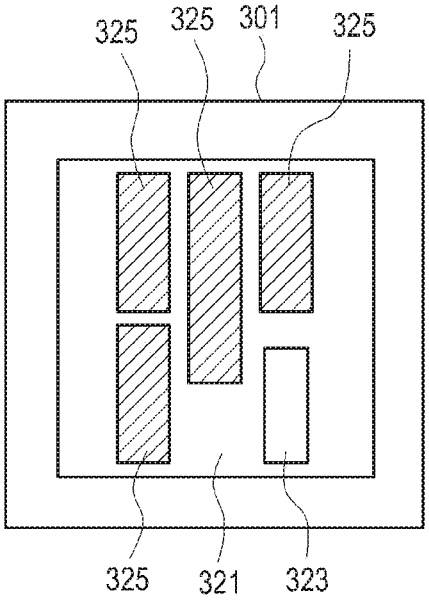
Figure 22:
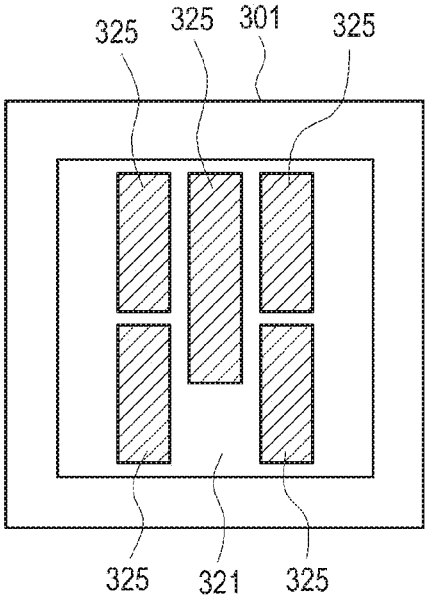

In FIG. 23, "original" represents the reflection coefficient of the antenna device 300 illustrated in FIG. 17, and "case 1" to "case 5" represent the reflection coefficients of the antenna devices 300 that are tuned in the forms of FIGS. 18 to 22, respectively. As illustrated in FIG. 23, it can be seen that, depending on the arrangement of the short circuit portions 325, the resonance frequency of the antenna device 300 can be variously formed.

The following Table 2 represents resonance frequencies that were obtained as a result of measuring the antenna devices 300, which have the tuning structures illustrated in FIGS. 17 to 22, respectively, and changes of the resonance frequencies that were obtained as a result of measuring the tuning structures with respect to the antenna device illustrated in FIG. 17. Such measurements were performed based on a structure in which a slot arranged at the center of the drawing in the horizontal direction was designed to have a length of 0.12 times the resonance frequency wavelength of the antenna device 300 (e.g., 0.6 mm) and one pair of slots arranged at left and right sides was designed to have a length of 0.08 times the resonance frequency wavelength of the antenna device 300 (e.g., 0.4 mm).

TABLE 2

| | original | Case 1 | Case 2 | Case 3 | Case 4 | Case 5 |
|---|---|---|---|---|---|---|
| Resonance frequency (GHz) | 58.10 | 60.35 | 61.00 | 61.30 | 61.60 | 62.25 |
| Resonance frequency change (GHz) | — | 2.25 | 2.90 | 3.20 | 3.50 | 4.15 |

As represented in Table 2, it can be confirmed that a resonance frequency change of about 2.25 GHz appears as the short circuit portion 232 is disposed in the slot disposed in the center of the radiation patch 321 in the structures illustrated in FIGS. 17 to 22. While the slots, which are respectively arranged in the left and right portions of the radiation patch 321, had the same size, the level of changing the resonance frequency differently appeared depending on the positions thereof. For example, when the short circuit portion 325 is arranged on the slot positioned in the right portion of the radiation patch 321, there was a resonance frequency change of about 0.65 GHz, and when the short circuit portion 325 is arranged on the slot positioned in the left portion, there was a resonance frequency change of about 0.30 GHz. The slots having the same size have different effects on the resonance frequency change due to a difference according to the distribution of the signal currents of the radiation patch 321. As described above, the antenna devices 300, which have the same structure, may implement different operating characteristics depending on the combinations of the slots in which the short circuit portions 325 are arranged.

As described above, according to various embodiments of the present disclosure, the antenna devices, which have substantially the same external structure, may implement different and various operating characteristics depending on the combinations of the tuning units, which are selectively short-circuited to the radiator. Accordingly, even if an antenna device has a structure in which it is hard to adjust an operating characteristic after fabrication like an antenna device that is used for mmWave communication, an operating characteristic required for the electronic device can be easily secured.

According to various embodiments of the present disclosure, since a plurality of tuning units are disposed adjacent to a radiator or on the radiator, antenna devices can be easily manufactured, which have variously different operating characteristics depending on a tuning unit connected to the radiator, respectively. Accordingly, since it is possible to select an antenna device among antenna devices in which tuning units connected to a radiator are different from each other, and to mount or replace the antenna device, an operating characteristic required for an electronic device can be easily secured. Accordingly, even if a mounted antenna cannot exhibit an operating characteristic required for an electronic device, it is possible to again select another antenna device in which the tuning unit connected to a radiator is different from that in the mounted antenna device even if the antenna device is not developed and manufactured again. Thus, it is possible to reduce the time and expense required for manufacturing the antenna device and, hence, the time and expense required for manufacturing an electronic device that is mounted with the antenna device.

In the foregoing detailed description, specific embodiments of the present disclosure have been described. However, it will be evident to a person ordinarily skilled in the art that various modifications may be made without departing from the scope of the present disclosure.

For example, while specific embodiments of the present disclosure have been described with reference to a case in which the antenna device has a Yagi-Uda antenna structure, an antenna structure having a grid type radiator, or a patch type antenna structure as an example, the present disclosure may be more variously implemented by arranging tuning units around a radiator in the various types of antennas, such as an inverted-F antenna, a monopole antenna, a slot antenna, a loop antenna, a horn antenna, and a dipole antenna.

What is claimed:

1. An antenna device comprising:

a circuit board including a plurality of layers laminated in the circuit board, a radiator formed in the circuit board and configured to be provided with a power feeding signal, the radiator being formed by a plurality of first via holes formed in each of the plurality of layers;

a plurality of tuning units formed in the circuit board and disposed adjacent to or on the radiator, the plurality of tuning units including a plurality of second via holes and a plurality of second via pads formed in each of the plurality of layers;

at least one short circuit portion; and a ground, wherein the plurality of second via pads are arranged in a region between the radiator and the ground, wherein each of the tuning units is selectively short-circuited to the radiator via the at least one short circuit portion, or adjacent tuning units are selectively short-circuited to each other.

2. The antenna device of claim 1, wherein the plurality of first via holes are arranged in one of the plurality of layers in a horizontal direction, and respective first via holes of the plurality of first via holes formed in one of the plurality of layers are aligned with the first via holes formed in another one of the plurality of layers such that the radiator is formed as a grid type.

3. The antenna device of claim 2, further comprising:

a plurality of first via pads provided between a first layer of the plurality of layers and a second layer adjacent to the first layer, wherein each first via pad of the plurality of first via pads interconnects a first via hole formed in the first layer and a first via hole formed in the second layer.

4. The antenna device of claim 3, wherein the plurality of second via pads are arranged in each of the plurality of layers adjacent to opposite ends of the first via pads in the horizontal direction.

5. The antenna device of claim 4, wherein the plurality of second via holes formed in each of the plurality of layers are connected to at least one second via pad of the plurality of second via pads.

6. The antenna device of claim 1, wherein the at least one short circuit portion is arranged in a same layer with at least one second via pad of the plurality of second via pads and is configured to short circuit the at least one of the second via pad to the radiator.

* * * * *